US005135313A

United States Patent [19]

Bowman

[11] Patent Number: 5,135,313

[45] Date of Patent: Aug. 4, 1992

[54] CHAIN-OF-CUSTODY BAG

[75] Inventor: Danny C. Bowman, Greensboro, N.C.

[73] Assignee: GBF Medical Group, Greensboro, N.C.

[21] Appl. No.: 745,284

[22] Filed: Aug. 14, 1991

[51] Int. Cl.[5] ..... B65D 33/34

[52] U.S. Cl. ..... 383/5; 383/66; 383/62; 383/83; 383/89; 229/70

[58] Field of Search ..... 383/5, 66, 78, 83, 88, 383/89, 62; 206/438, 439, 465, 831; 229/70

[56] References Cited

U.S. PATENT DOCUMENTS

| | | | |
|---|---|---|---|
| 2,793,743 | 5/1957 | Lefebvre . | |
| 3,151,803 | 10/1964 | Kaminski . | |
| 3,368,741 | 2/1968 | Mercur | 229/70 |
| 3,655,118 | 4/1972 | Rinecker . | |
| 3,764,061 | 10/1973 | Hulbert | 229/70 |
| 4,358,015 | 11/1982 | Hirsch | 206/439 |
| 4,509,196 | 4/1985 | Sak et al. | 383/66 |
| 4,706,996 | 11/1987 | Fasham | 229/71 X |
| 4,709,399 | 11/1987 | Sanders | 383/66 |
| 4,759,494 | 7/1988 | Smyth | 383/108 |
| 4,786,190 | 11/1988 | Van Erden et al. | 383/66 X |

FOREIGN PATENT DOCUMENTS

| | | | |
|---|---|---|---|
| 1470786 | 4/1977 | United Kingdom | 206/439 |
| 2177677 | 1/1987 | United Kingdom | 383/66 |
| 2221208 | 1/1990 | United Kingdom | 383/88 |

*Primary Examiner*—Stephen Marcus
*Assistant Examiner*—Jes F. Pascua
*Attorney, Agent, or Firm*—Sixbey, Friedman, Leedom & Ferguson

[57] ABSTRACT

A chain-of-custody bag is disclosed which provides for the sealing of a specimen taken at a remote location within the bag for transportation to an analysis site. The specimen bag advantageously includes a specimen label conveniently mounted to the specimen bag which is removable therefrom for use on the specimen when placed in the specimen bag. More specifically, the specimen label is provided on top of a protective backing layer that is further provided to cover an adhesive band that acts as the closure for sealing the bag once a specimen is placed therein. The result is that the specimen label can be conveniently located on the bag to be adhered to the specimen and inserted within the bag, and the bag can be sealed thereafter.

12 Claims, 4 Drawing Sheets

CHAIN-OF-CUSTODY BAG

TECHNICAL FIELD

This invention relates generally to flexible specimen bags and particularly to specimen bags that are sealed after the specimen is placed therein so that any attempted tampering with the specimen will be indicated by at least a partial destruction of the seal so that chain-of-custody of the specimen can be established.

BACKGROUND OF THE INVENTION

Many types of specimen bags are presently available for use in establishing chain-of-custody of a specimen without tampering. Such specimen bags are used for collecting a specimen at a remote location which is to be analyzed at another location, such as a laboratory, and for ensuring that the specimen is not contaminated or tampered with during transfer or storage of the specimen. Moreover, specimen bags are particularly useful for collecting biological specimens such as urine, blood, and the like, but can also be used in the collection of other type specimens such as for water or pollutant analysis, agricultural analysis or the like. In any of these cases, it is important that it can be established that the specimen was not tampered with between the taking of the specimen and the analysis of the specimen to ensure accurate and verifiable results.

Typically, for collecting a specimen, the specimen is collected at a remote location and is sealed within a specimen container such as a vial or the like. Then, a specimen label is normally adhered to the vial so as to identify the specimen. Such a label may also provide the dual function of sealing the vial and providing a tamper-indicating means by which opening the vial will result in destruction of the label. After the specimen has been labeled, the vial will be placed within a specimen bag. Such a specimen bag, as in the prior art, typically includes a sealing means such that the inside of the bag can be closed off and sealed so as to prevent contaminants from entering the bag and for providing a seal that is destroyed when the bag is opened.

In a known specimen bag, a transparent flexible bag is provided defined by opposing wall panels with one of the wall panels having a slit therein for access to the inside of the bag. Moreover, such a prior art bag is known to include a strip of adhesive provided adjacent the slit on either side thereof or on both sides of the slit, which is covered by a backing strip. Thus, when the backing paper layer is removed, the adhesive is exposed and the bag can be sealed by folding the slit onto the adhesive strip.

An example of a flexible plastic sample bag including an opening with an adjacent adhesive strip covered by a protective strip can be found in U.S. Pat. No. 3,819,106 to Schuster. Another example of a known specimen bag comprises a similar flexible plastic bag including a slit in one of the opposed wall panels, wherein an adhesive layer is provided on both sides of the slit with a protective strip thereover. In both of the above examples, the protective strip is removed and the bag is folded so that the slit engages the adhesive strip for sealing.

Other prior art flexible bags including access openings in a side wall with an adhesive closure are shown and described in U.S. Pat. Nos. 3,655,118 to Rinecker, 4,550,831 to Whitford, and 4,786,190 to Van Erden et al. Of these, the Rinecker and Van Erden et al. flexible bags are specifically provided with closure devices allowing reopening and closing of the closures many times.

None of the afore-mentioned prior art bags, however, contemplate the provision of any type of tamper-indicating or identification label on the bag for use on the specimen.

Heretofore, if such a specimen label was to be used in conjunction with a specimen bag for being adhered to a specimen that will be placed within the bag, it was necessary to bring along a separate specimen label for that purpose. More specifically, in a typical situation, a specimen taker would have a plurality of specimen bags on hand and would also have a roll or stack of adhesive-backed labels of the peel-and-stick type which could be adhered to the specimen prior to insertion within the bag. Such a situation is disadvantageous in that it is inconvenient to have to carry or have available both a separate bag and a separate specimen label in order to take a specimen, particularly when the specimen is taken at a remote location. Moreover, when relying on the bag to establish chain-of-custody, it is imperative that it can be shown that the flexible bag was sealed in a condition with the specimen sealed therein. If one had only the bag available and had forgotten or misplaced the specimen label, he would not be able to seal the bag until the specimen was correctly labeled. To seal the bag at a location other than the specimen-taking location would compromise the chain-of-custody which could not then be definitely established. When dealing with such a chain-of-custody situation, it is necessary that all activities concerning the specimen be completed at the location that the specimen is taken so that once the specimen is sealed within the flexible chain-of-custody bag the specimen will not be tampered with. This is, of course, what establishes the chain-of-custody.

Regarding the basic use of labels in combination with a flexible bag or package, a reusable mailing device is disclosed in U.S. Pat. No. 3,151,803 to Kaminski. The Kaminski mailer has an access slit through one wall panel and an adhesive address strip which is used not only to indicate where the package is to go but also to seal the slit. However, the address strip is adhered directly on the envelope, as opposed to being adhered to an article inserted in the mailer, after it is filled out and is thrown away after opening. The Kaminski device is reusable only by putting a new address label over the slit for closing the envelope for each usage of the envelope.

In another type package, a pocket is provided on a package within which indicia bearing material can be contained which is visible from the outside of the package, as shown in U.S. Pat. No. 2,793,743 to Lefebvre.

In Lefebvre, the package as well as the pocket can be sealed by a seperate adhesive strip on the bag. In both Kaminski and Lefebvre, the disclosed labels are strictly used to be visible on the outside of the package and are not used on any article provided inside the bag or package. Moreover, none of the prior art specimen or other type bags disclose a label removably secured to the bag or package which is then used on an article.

SUMMARY OF THE INVENTION

It is an object of the present invention to provide a specimen bag that is convenient and which overcomes the deficiencies associated with prior art specimen bags.

It is a further object of the present invention to provide a specimen bag including an opening through one of the side wall panels forming the bag through which a specimen can pass in combination with an adhesivebacked specimen label that is conveniently and removably positioned on the specimen bag and for removal from the bag and adherence to a specimen that is placed within the bag.

It is another object of the present invention to provide a chain-of-custody bag including a removable specimen label positioned on the bag for removal and adherence to a specimen placed within the bag, and also to provide a sealing means for closing off the interior of the bag and sealing the bag after a specimen is placed therein. Such a combination advantageously allows the specimen to be placed and sealed within a specimen bag immediately at the location that the specimen is taken for ensuring the establishment of chain-of-custody of the specimen.

It is yet another object of the present invention to provide a chain-of-custody bag including a closure means for sealing a slit that cuts through one wall panel of the bag which comprises an adhesive strip covered by a protective backing layer, which is further covered by the adhesive-backed specimen label for convenient and quick access to the specimen label for adherence to a specimen placed within the bag. This combination advantageously permits the specimen label to be completed, if necessary, at the location of the specimen taking in a convenient manner which, once completed, can be adhered to the specimen and placed within the bag. Moreover, the specimen label is preferably used on the specimen container or vial in a way to act as a tamper-indicating label as well. By providing the adhesive-backed specimen label on the protective backing layer of the bag closure means, the specimen label is conveniently located and can be quickly and easily removed from the bag and adhered to a specimen without the need for any special provision on the bag made for connecting the specimen label to the bag.

These and other objects of the present invention are achieved by a flexible, plastic bag having opposed wall panels which are secured together to define a specimen receiving space therebetween. One of the opposed wall panels includes a slit extending traversely across the bag through which a specimen can be positioned within the specimen receiving space of the bag. At a position nearby or over the slit, the bag is provided with an adhesive area or band which is used to seal the bag when it is folded into its sealed condition. A removable protective backing layer is provided over the adhesive band which protects the adhesive from exposure to contaminants and from sticking to the bag before sealing. Furthermore, on top of the protective backing layer, a label is provided for adherence to a specimen to be received within the bag. This label is preferably a tamper-indicating label and may include information regarding the specimen. The result is that everything that is needed for taking a specimen is conveniently provided in a way so as not to compromise the chain-of-custody of the specimen and to prevent contamination and/or tampering of the specimen.

These and further objects, features and advantages of the present invention will become more apparent from the following description when taken in conjunction with the accompanying drawings which show for purposes of illustration only, a preferred embodiment in accordance with the present invention.

DETAILED DESCRIPTION OF THE PREFERRED EMBODIMENT

Figure 1:
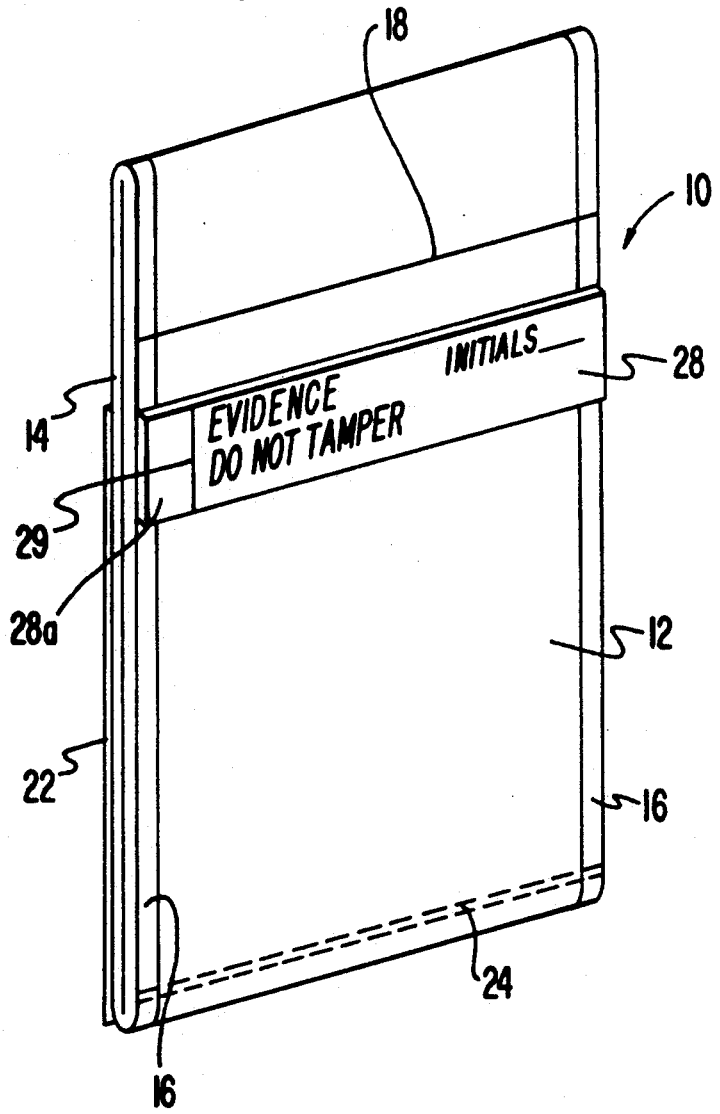
FIG. 1 is a perspective view of a bag structure and specimen label in accordance with the present invention.

Referring now to the drawings, and in particular to FIG. 1, a chain-of-custody bag 10 is illustrated in accordance with the present invention. The bag 10 is comprised of a pair of opposed wall panels including a front wall panel 12 and a rear wall panel 14. The front and rear wall panels 12 and 14 are secured together at longitudinally extending edges by heat seals 16. In order to accomplish the heat sealing at 16, it is understood that the front and rear wall panels 12 and 14 are composed of a plastic material that is capable of heat sealing in a conventional manner. It is further understood that if heat sealing would not be effective for the chosen flexible bag material, or if otherwise desired, adhesive could be substituted for the heat sealing to secure the front and rear wall panels 12 and 14 together. Moreover, the front and rear wall panels 12 and 14 could be composed of material other than plastic, such as paper or the like, which would be connected by adhesive or in other known manners. Preferably, the front and rear wall panels 12 and 14 are made of transparent plastic material which is suitable for heat sealing at 16 to secure the panels together.

Figure 2:
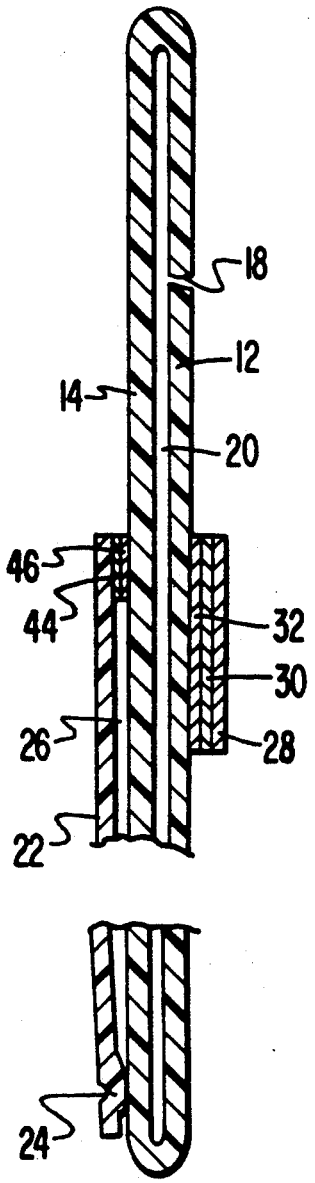
FIG. 2 is a longitudinal cross-sectional view taken through the bag of FIG. 1.
Figure 4:
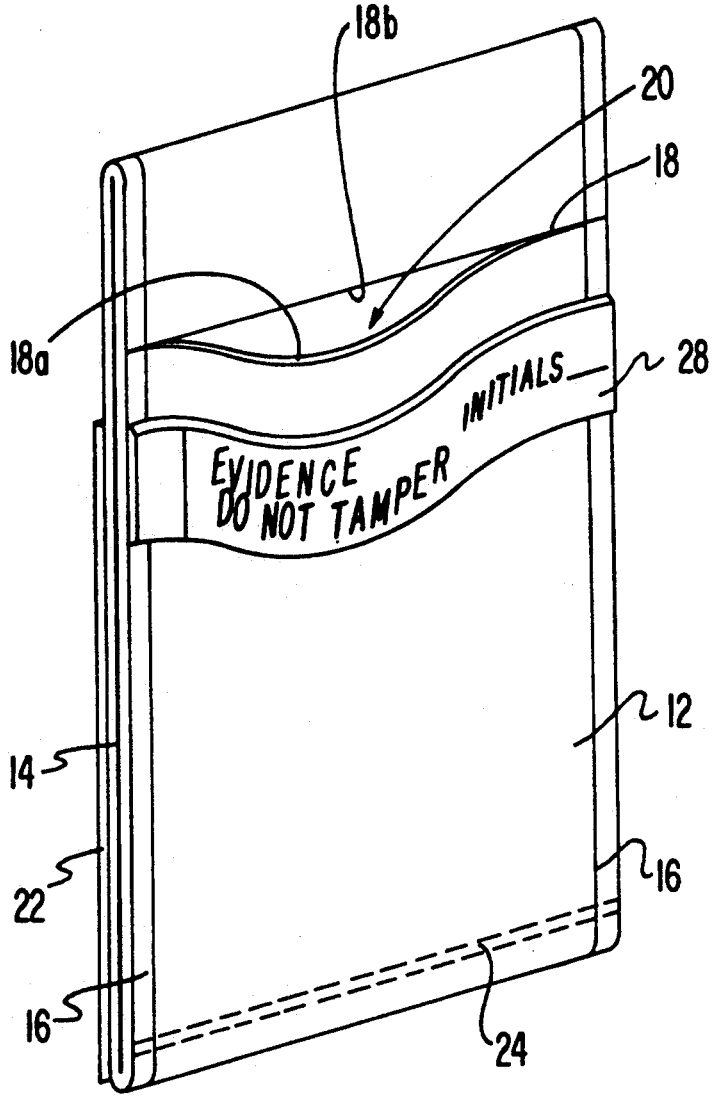
FIG. 4 is a perspective view of the bag of FIG. 1 showing the bag open for receiving a specimen therein.

Within one of the wall panels, preferably front wall panel 12, a slit 18 is provided through which access can be had to an internal specimen receiving space 20 defined within the bag 10 (see the cross-section view of bag 10 shown in FIG. 2). Access to the specimen receiving space 20 through slit 18 is illustrated in FIG. 4 wherein a lower edge **18*a* of the slit 18 is pulled away from the upper edge 18*b* of the slit 18. The degree of opening is, of course, dependent on the size of specimen intended to be placed within the specimen receiving space 20**.

Also included and fixed to the rear wall panel 14 is an auxiliary pocket defining panel 22 which is fixed to the rear wall panel 14 along its longitudinal edges by the heat seals 16 and along the bottom transverse edge by a heat seal 24. Thus, the panel 22 defines an auxiliary pocket 26 that is open at its top edge and closed along both sides and the bottom edges (see FIG. 2). The auxiliary pocket 26 is preferably provided on the chain-of-custody bag 10 so that paperwork or similar material associated with the specimen that is to be received within the specimen receiving space 20 can be included with the specimen.

A specimen label 28 is further removably provided on the bag 10. Preferably, the specimen label 28 is removably positioned on the bag 10 at a point below the slit 18 and spaced therefrom by only a relatively short distance. The reason for this location will be apparent below. Moreover, the specimen label 28 comprises an adhesive-backed label of the peel-and-stick type which may or may not include indicia on the front side thereof relating to the specimen that is to be placed within the bag 10. Since the bag 10 is to be used as a chain-of-custody bag, the label illustrated in the figures is a tamper-indicating label which is to be adhered to a specimen placed within the bag 10 and includes a warning to that effect with a space provided for the initials of the person bagging the specimen. It is, of course, understood that any other indicia desired may be provided on the specimen label 28 in conjunction with or instead of the illustrated warning.

As can be seen in FIG. 2, the specimen label 28 is releasably positioned directly on top of a protective backing strip 30. This backing strip 30 advantageously provides a dual purpose in that not only is specimen label 28 easily removable therefrom, the protective backing strip 30 functions as a protective layer that covers a layer of adhesive 32 that is provided on an area or band extending across the front wall panel 12 of the bag 10. The protective backing strip 30 can be composed of a waxed impregnated paper as is well known or any other conventional material to which the adhesive will not adhere, including plastics. Note the protective backing strip 30 must be releasable on both top and bottom surfaces.

Figure 3:
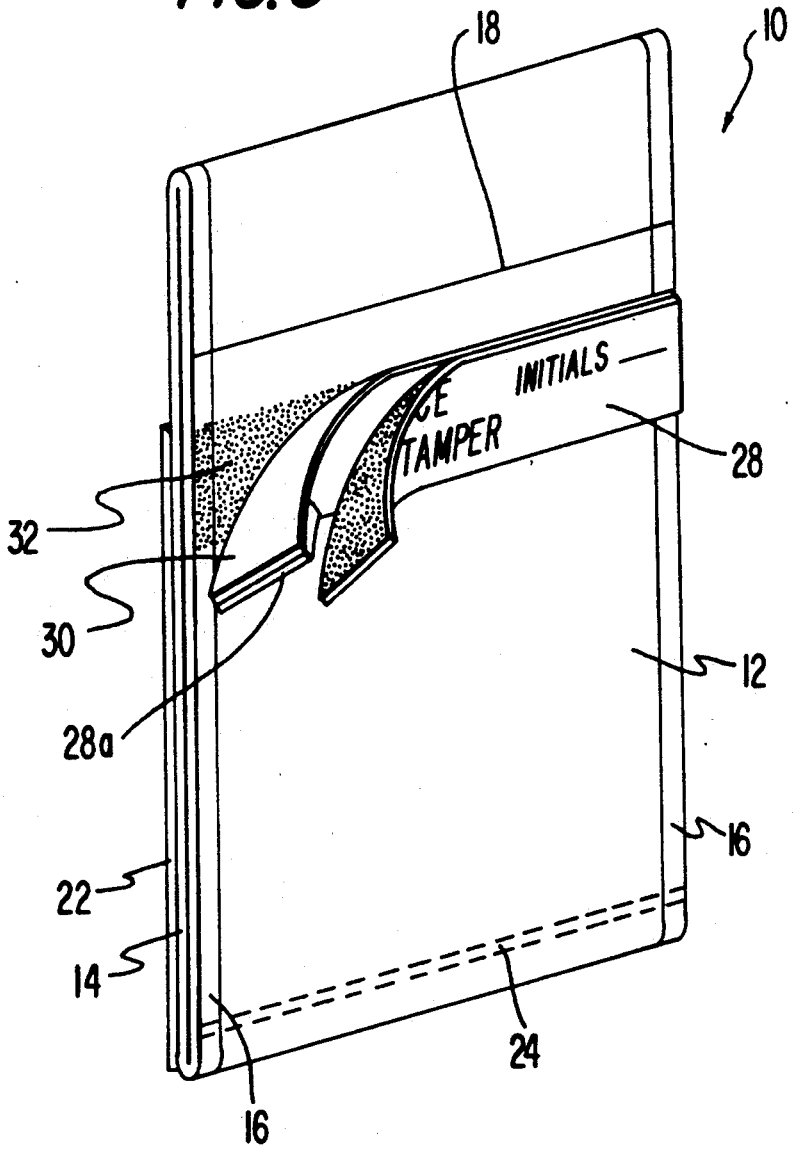
FIG. 3 is a perspective view of the bag of FIG. 1 illustrating the removable specimen label and protective backing layer of the present invention.

As shown in FIG. 3, the specimen label 28 has adhesive on its rear side which faces a top layer of the protective backing strip 30. Note that the specimen label 28 includes a cut at 29 which defines a portion 28*a* that facilitates removal of the specimen label 28 in a well-known manner. Furthermore, since the protective backing strip 30 is composed of a material to which the adhesive of the specimen label 28 does not stick, such as a wax impregnated paper, plastic or the like, the specimen label 28 is easily removable. As also shown in FIG. 3, the protective backing layer 30 can be released from the adhesive band 32 without adversely affecting the adhesive. The adhesive used in the adhesive band 32 is preferably a pressure-sensitive adhesive such as is well known in the art.

Figure 6:
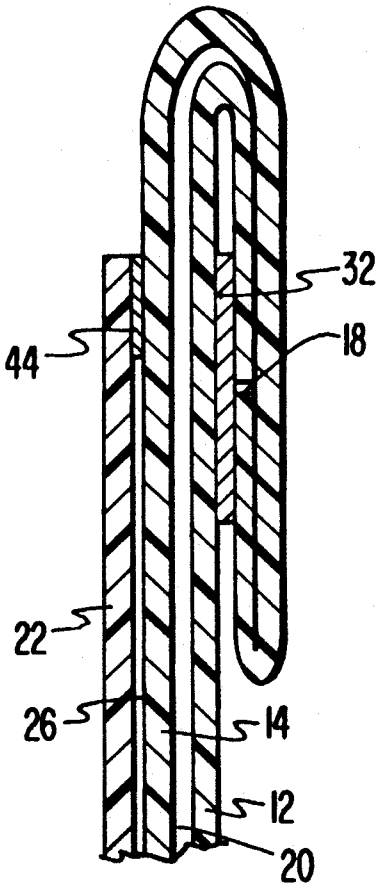
FIG. 6 is a longitudinal cross-sectional view taken through the closed bag shown in FIG. 5.
Figure 5:
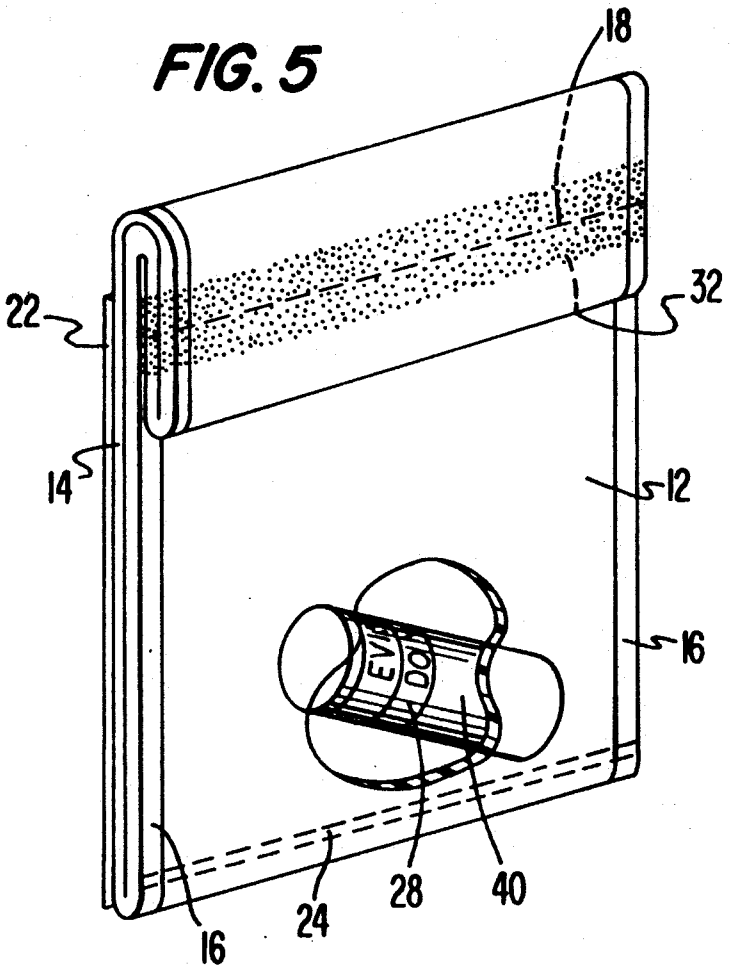
FIG. 5 is a perspective view of the bag of FIG. 1 with a combined specimen and specimen label received within the bag, and the bag sealed in a closed position.

The use of the chain-of-custody bag 10 for sealing a specimen therein will now be described with reference to the Figures. Starting with the orientation of the bag 10 as shown in FIGS. 1 and 2, such a bag is normally taken to the location at which a specimen is to be obtained. The actual specimen can be put within any container depending on the type of specimen taken, such as a vial, cup and lid, or similar receptacle. Once the specimen is contained within the receptacle, which hereinafter will be referred to as a vial for the sake of an example, the specimen label 28 will be removed in the manner illustrated in FIG. 3. Thereafter, the specimen label 28 will be adhered to the vial to identify the specimen and/or to provide a tamper-indicating means once adhered to the vial. Then, the vial with a specimen therein and with the specimen label 28 thereon can be positioned within the specimen receiving space 20 defined within the bag 10 through the slit 18, as shown in FIG. 4 (note that the specimen label 28 would be removed from the bag). Next, with the specimen and specimen label 28 within the specimen receiving space 20, the protective backing strip 30 is removed to reveal the adhesive band 32. Referring now to FIGS. 5 and 6, the adhesive band 32 provides a closure means by which the slit 18 is sealed and the specimen receiving space 20 is closed. More specifically, the top end of the bag 10 is folded forwardly such that the slit 18 is brought into contact with the adhesive band 32. Thus, the slit is sealed and the specimen receiving space 20 is closed. Moreover, the adhesive band 32 becomes sealed between both of the adjacent portions of the front wall panel 12 next to the slit 18 and the front wall panel 12 underneath the adhesive band so as to form a seal that, if broken, will destroy the bag to at least some degree. The result of this is that any tampering to the bag would be indicated by at least some destruction of the bag 10. The location of the adhesive band 32 on the bag 10 is determined soley by its function to seal the slit 18, thus, it is understood that the location could be closer to, further from, or directly over the slit 18. Moreover, if the top of the bag 10 was folded rearwardly, the adhesive band 32 could be on the rear wall panel 14 instead of the front wall panel 12.

Also in FIG. 5, the specimen label 28 is illustrated in a way to act as a tamper-indicating label. More specifically, such a tamper-indicating specimen label 28 is adhered to the specimen so as to overlap the separation between the plural components of the specimen vial 40. It is understood that any such receptacle having separable components will necessarily define a line of joinder which can be covered by at least a portion of such a label so that if the components are attempted to be separated, the label will be at least be partially destroyed.

Once the specimen is contained within the vial, and the vial is adhered with a specimen label 28, is placed within the specimen receiving space 20, and is sealed within the bag 10 by folding the slit 18 over the adhesive band 32 and pressed together, the sealed specimen bag 10 can be relocated or stored as necessary. Such relocation typically involves the transfer of the specimen from the remote specimen site to a laboratory for analyzing. Moreover, any appropriate papers or materials can be inserted within auxiliary pocket 26 to go with the specimen taken at the remote location. To facilitate this, a small adhesive strip 44 is provided at the upper end of the auxiliary panel to be secured to the rear wall panel 14 of the bag 10. Moreover, a protective strip 46 covers the small adhesive strip 44, which is removed once any material is placed within the auxiliary pocket 26 so as to effectively close the auxiliary pocket 26.

Although the illustrated embodiment of a chain-of-custody bag 10 is described comprised of transparent plastic film which is heat sealed to define the specimen receiving space 20, and auxiliary pocket 26, it is understood that any other flexible material suitable for making a bag can be used. Moreover, the plastic film contemplated could be a single film layer or could be a multi-layer laminate designed with specific properties for a particular specimen. For example, if biological or medical samples are to be taken, it would be preferable that the bag material have the property of preventing bacterial migration into or out of the bag. In contrast, it may not be necessary for the bag to have certain properties when taking other types of specimens such as those for agriculture or water. In any case, the bag can effectively provide a chain-of-custody bag which if tampered with will be at least partially destroyed indicating such tampering. Thus, the required chain-of-custody of a bag not tampered with can be established. Moreover, such bags can be conveniently used in the field and can be reliably transported to a laboratory for analysis without compromising the quality of the specimen.

I claim:

1. A specimen bag for storing a specimen therein having opposed wall panels secured together to define a specimen receiving space therebetween, said bag comprising a slit through one of said opposed wall panels through which the specimen can be positioned within said specimen receiving space, an adhesive backed specimen label removably positioned on said bag for removal from said bag and adherence to a specimen to be received in said specimen receiving space; a closure means for sealing said slit and closing said specimen receiving space; said closure means including an adhesive band provided on the one of said opposed wall panels that said slit passes through so that the bag can be folded over to seal said slit to said adhesive band; and a releasable protective backing strip sized to cover said adhesive band and which si removable to expose said adhesive band to seal said slit and close said specimen receiving space; wherein said specimen label is removably provided on one of said opposed wall panels by being releasably adhered on top of said releasable backing layer.

2. The bag of claim 1, wherein said specimen label includes a means for indicating tampering of the specimen received in said specimen receiving space.

3. The bag of claim 1, wherein said specimen label is positioned on said bag so as not to obstruct said slit.

4. The bag of claim 1, wherein said specimen label, said protective backing strip, and said adhesive band are positioned on said bag so as not to obstruct said slit.

5. A specimen bag for storing a specimen therein having opposed wall panels secured together to define a specimen receiving space therebetween, said bag comprising a slit through one of said opposed wall panels through which the specimen can be positioned within said specimen receiving space, a closure means for sealing said slit and closing said specimen receiving space, and an adhesive backed specimen label removably positioned on said bag for removal form said bag and adherence to a specimen to be received in said specimen receiving space; wherein said specimen label includes a means for indicating tampering of the specimen received in said specimen receiving space.

6. The bag of claim 5, wherein said closure means comprises an adhesive band provided on the one of said opposed wall panels that said slit passes through so that the bag can be folded over to seal said slit to said adhesive band.

7. The bag of claim 6, further including a releasable protective backing strip sized to cover said adhesive band and which is removable to expose said adhesive band to seal said slit and close said specimen receiving space.

8. The bag of claim 7, wherein said specimen label is removably provided on one of said opposed wall panels by being releasably adhered on top of said releasable backing layer.

9. The bag of claim 8, wherein said specimen label, said protective backing strip, and said adhesive band are positioned on said bag so as not to obstruct said slit.

10. The bag of claim 5, wherein said specimen label is positioned on said bag so as not to obstruct said slit.

11. A chain-of-custody bag for storing a specimen therein having opposed wall panels secured together to define a specimen receiving space therebetween, said bag comprising a slit through one of said opposed wall panels through which the specimen can be positioned within said specimen receiving space, a closure means for sealing said slit and closing said specimen receiving space , and an adhesive backed specimen label removably positioned on said bag for removal from said bag and adherence to a specimen to be received in said specimen receiving space, wherein said closure means comprises an adhesive band provided on the one of said opposed wall panels through which said slit passes, said adhesive band is covered by a protective backing strip, and said specimen receiving label is removably positioned on top of said protective backing strip.

12. The bag of claim 11, wherein said adhesive band, said protective backing strip, and said specimen label are positioned on said bag so as not to obstruct said slit.

* * * * *